US007739936B2

(12) United States Patent
Chan

(10) Patent No.: US 7,739,936 B2
(45) Date of Patent: Jun. 22, 2010

(54) PAPER PUNCH

(75) Inventor: Kwok Ki Stephen Chan, Hong Kong (HK)

(73) Assignee: Lee Tack Plastic & Metal Manufacturing Ltd, New Territories (HK)

( * ) Notice: Subject to any disclaimer, the term of this patent is extended or adjusted under 35 U.S.C. 154(b) by 114 days.

(21) Appl. No.: 11/623,636

(22) Filed: Jan. 16, 2007

(65) Prior Publication Data

US 2008/0168878 A1 Jul. 17, 2008

(51) Int. Cl.
*B26F 1/14* (2006.01)

(52) U.S. Cl. ..... 83/447; 83/686

(58) Field of Classification Search ..... 83/686, 83/564, 455, 447, 450
See application file for complete search history.

(56) References Cited

U.S. PATENT DOCUMENTS 3,580,121 A * 5/1971 Asada et al. ..... 83/107
4,030,387 A * 6/1977 Finnimore ..... 83/49
4,987,811 A * 1/1991 Ikarashi et al. ..... 83/372
5,156,076 A * 10/1992 Rosemann ..... 83/344
5,601,006 A * 2/1997 Quinn et al. ..... 83/588
2004/0129124 A1 7/2004 Chan

FOREIGN PATENT DOCUMENTS

| | | |
|---|---|---|
| EP | 1 741 526 A3 | 1/2007 |
| GB | 171 005 | 6/1921 |
| GB | 1 098 031 | 1/1968 |
| GB | 2 280 396 A | 12/1993 |
| KR | 10-0543508 | 1/2006 |
| NL | 7108902 | 7/1970 |

* cited by examiner

*Primary Examiner*—Kenneth E. Peterson
(74) *Attorney, Agent, or Firm*—William J. Sapone; Coleman Sudol Sapone P.C.

(57) ABSTRACT

A paper punch 100, 200 is disclosed as including a button 110, a die 104, and a die holder 106, 210 with an upper jaw 114, 208 and a lower jaw 116 which are spaced apart from each other, in which the button 110 is operable to move the die 104 relative to the die holder 106, 210 to punch at least a piece of paper out from a sheet of paper 117 received within the paper punch 117, and the die holder 106, 210 includes a wheel 120, 202 for limiting the extent of relative movement between the upper jaw 114, 208 and the lower jaw 116.

2 Claims, 9 Drawing Sheets

PAPER PUNCH

This invention relates to a paper punch, in particular such a paper punch suitable for paper crafting purposes.

BACKGROUND OF THE INVENTION

In the field of paper crafting, pieces of paper or cardboard of various shapes are punched out from sheets of paper or cardboard by paper punches. A first conventional paper punch is shown in FIG. 1 and generally designated as 10. The conventional paper punch 10 has a generally U-shaped body 12 with an open end 14 through which a sheet of paper or cardboard 16 may be inserted. Upon downward pressing of a button 18, a die (not shown) in the body 12 is brought down to punch out a piece of paper or cardboard 16*a*, as shown in FIG. 3. A second conventional paper punch is shown in FIG. 2 and generally designated as 20. The structure of the paper punch 20 is similar to that of the paper punch 10, with the major difference being that, in the paper punch 20, a lever 22 is downwardly pivoted to bring down a die (not shown) to punch a sheet of paper or cardboard.

It is well known in the field of production of paper punches that the performance of a paper punch highly depends on the proper alignment between the die and the die holder of the paper punch. In this connection, FIGS. 4*a* to 4*c* show various views of the internal components of the paper punch 10 during a punching action. As shown in particular in FIGS. 4*a* and 4*b*, when the button 18 is pushed down, a die 24 is brought down against the upwardly biasing force of a coil spring 26. During such a movement, and as shown in more detail in FIGS. 4*c* and 4*d*, an upper jaw 28 of a die holder 30 will bend downwardly towards a lower jaw 32, thus causing misalignment between the die 24 and the die holder 30. FIG. 4*c* shows clearly that a cutting edge 34 on a lower end of the die 24 strikes on an upper face of the lower jaw 32 of the die holder 30 during the punching movement, thus damaging the cutting edge 34, and the performance of paper punch 10 is adversely affected.

A similar situation also occurs in the second conventional paper punch 20, as shown in FIGS. 5*a* to 5*d*.

It is thus an object of the present invention to provide a paper punch in which the aforesaid shortcomings are mitigated, or at least to provide a useful alternative to the trade and public.

SUMMARY OF THE INVENTION

According to the present invention, there is provided a paper punch including an operating member; a die; and a die holder with an upper jaw member and a lower jaw member which are spaced apart from each other; wherein said operating member is operable to move said die relative to said die holder to punch at least a piece of paper out from a sheet of paper received within said paper punch; and wherein said die holder includes a restrictor adapted to limit the extent of relative movement between said upper and lower jaw members.

BRIEF DESCRIPTION OF THE DRAWINGS

Preferred embodiments of the present invention will now be described, by way of examples only, with reference to the accompanying drawings, in which.

DETAILED DESCRIPTION OF THE PREFERRED EMBODIMENTS

Although the present invention will hereinafter be referred to as and described in the context of a paper punch, it is also envisaged that the present invention is also suitable for a punch for punching cardboard and such like materials, and that the scope of protection should be construed accordingly.

Figure 1:
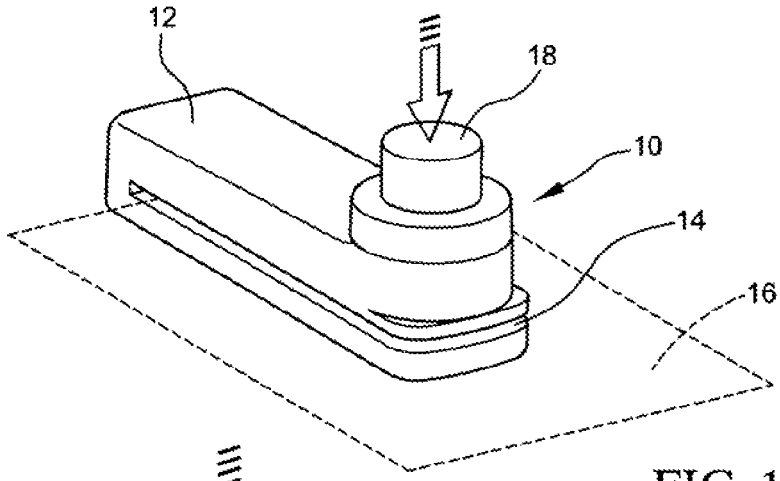
FIG. 1 ( PRIOR ART )
FIG. 1 is a perspective view of a first conventional paper punch.
Figure 2:
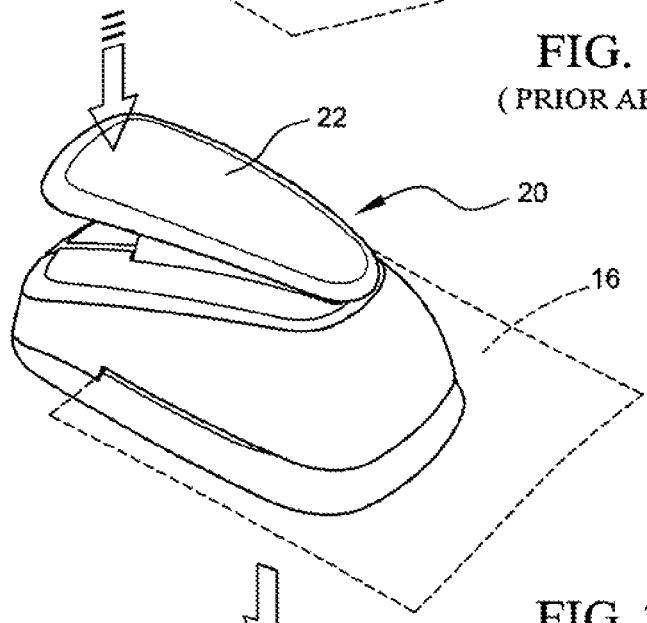
FIG. 2 ( PRIOR ART )
FIG. 2 is a perspective view of a second conventional paper punch.
Figure 3:
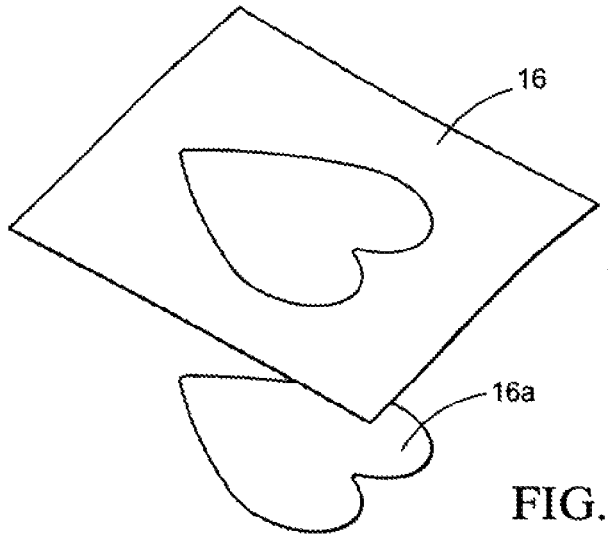
FIG. 3 shows a piece of shaped paper or cardboard cut out from a sheet of paper or cardboard.
Figure 4A:
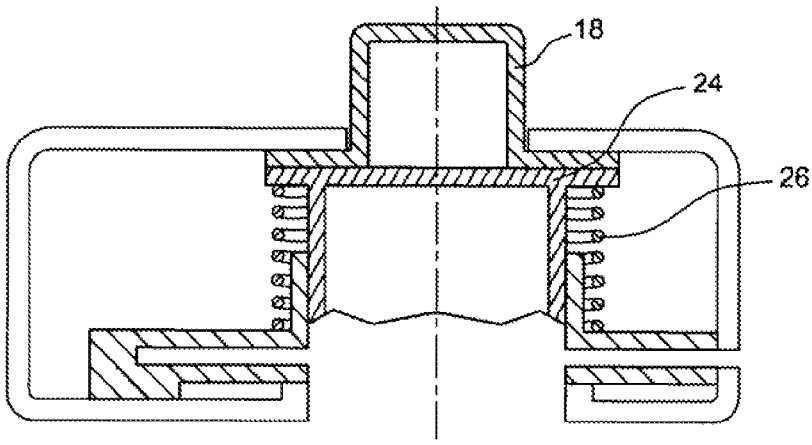
FIG. 4a ( PRIOR ART )
FIG. 4*a* is a sectional view of the conventional paper punch shown in FIG. 1 before a punching action.
Figure 4B:
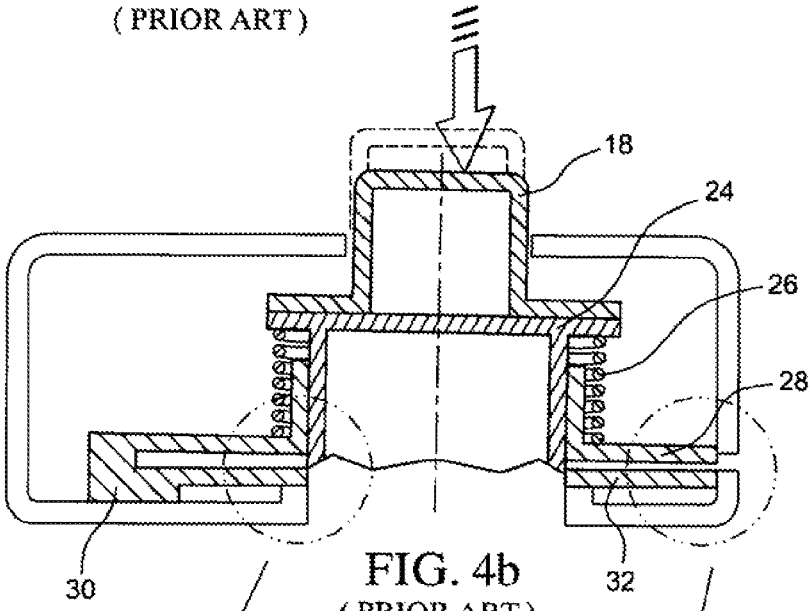
FIG. 4b ( PRIOR ART )
FIG. 4*b* is a sectional view of the paper punch shown in FIG. 4*a* after a punching action.
Figure 4C:
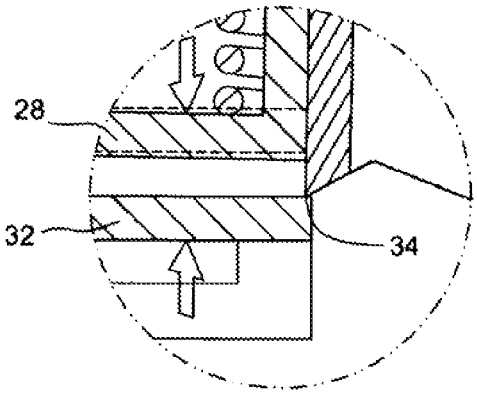
FIG. 4c ( PRIOR ART )
FIGS. 4*c* and 4*d* are enlarged views of the two encircled parts in FIG. 4*b;*
Figure 4D:
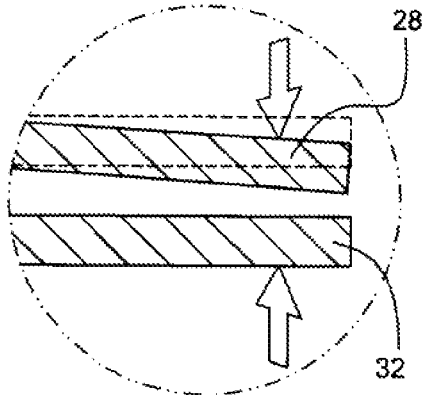
FIG. 4d ( PRIOR ART )
Figure 5A:
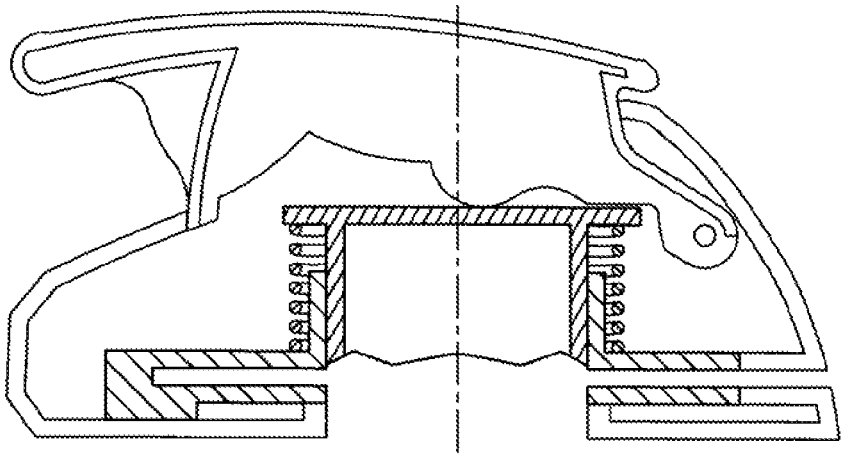
FIG. 5a ( PRIOR ART )
FIG. 5*a* is a sectional view of the conventional paper punch shown in FIG. 2 before a punching action.
Figure 5B:
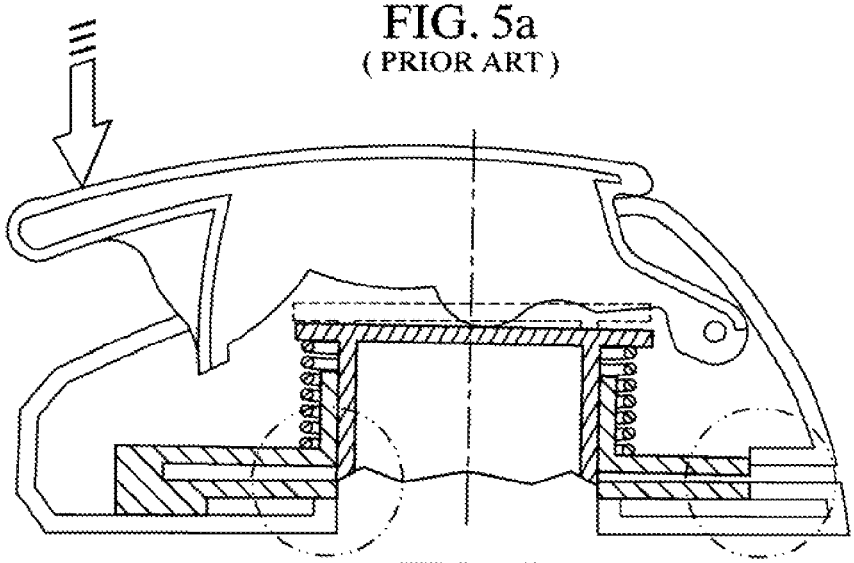
FIG. 5b ( PRIOR ART )
FIG. 5*b* is a sectional view of the paper punch shown in FIG. 5*a* after a punching action.
Figure 5C:
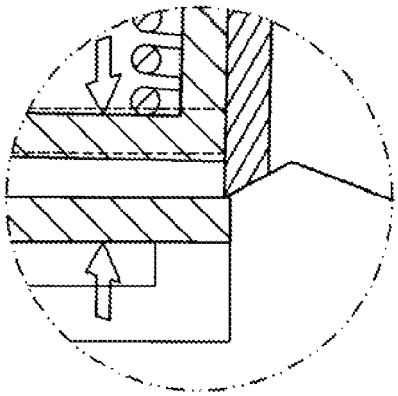
FIG. 5c ( PRIOR ART )
FIGS. 5*c* and 5*d* are enlarged views of the two encircled parts in FIG. 5*b;*
Figure 5D:
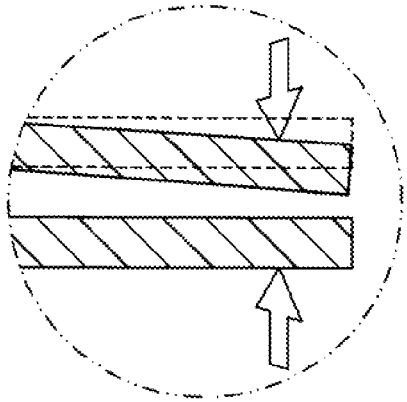
FIG. 5d ( PRIOR ART )
Figure 6A:
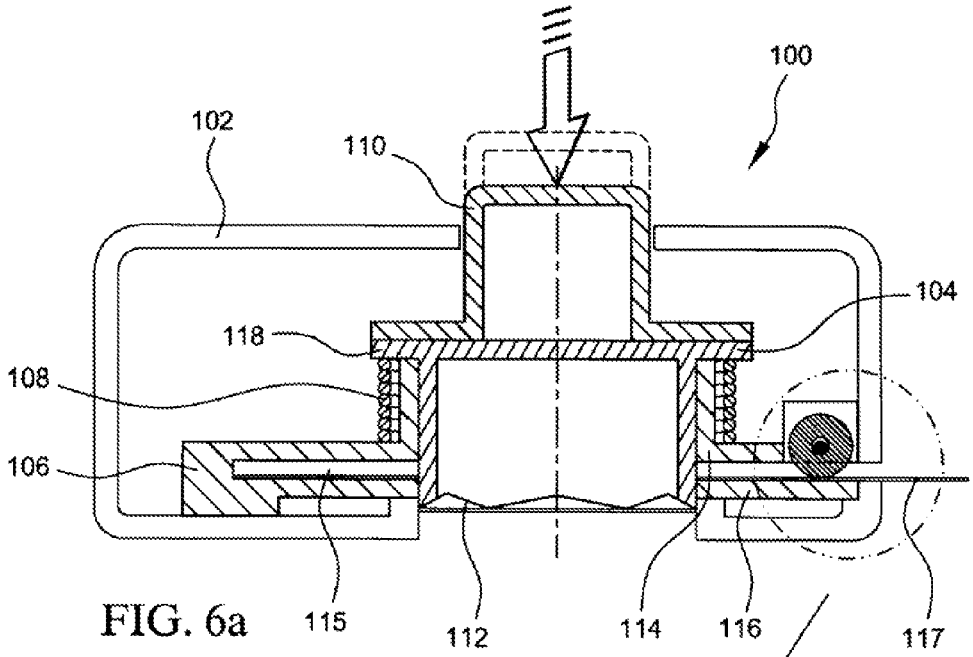
FIG. 6*a* is a sectional view of a paper punch according to a first embodiment of the present invention.

FIG. 6*a* shows a sectional view of a paper punch according to a first embodiment of the present invention, generally designated as 100. The paper punch 100 has a body 102 housing a die 104 and a die holder 106. The die 104 is biased away from the die holder 106 by a coil spring 108. Secured on the die 104 is a button 110 which may be depressed, e.g. by a user, to move the die 104 relative to the die holder 106 in the direction indicated by the arrow in FIG. 6*a*, so that a lower cutting edge 112 passes through a correspondingly shaped hole in an upper jaw 114, a slot 115 between the upper jaw 114, and a correspondingly shaped hole in a lower jaw 116 of the die holder 106, which is spaced apart from the upper jaw 114, to punch or cut out a piece of shaped paper from a sheet of paper 117. In FIG. 6*a*, the die 104 is in its lowermost position relative to the die holder 106, in which position part of the cutting edge 112 is below the lower jaw 116 of the die holder 106.

Figure 6B:
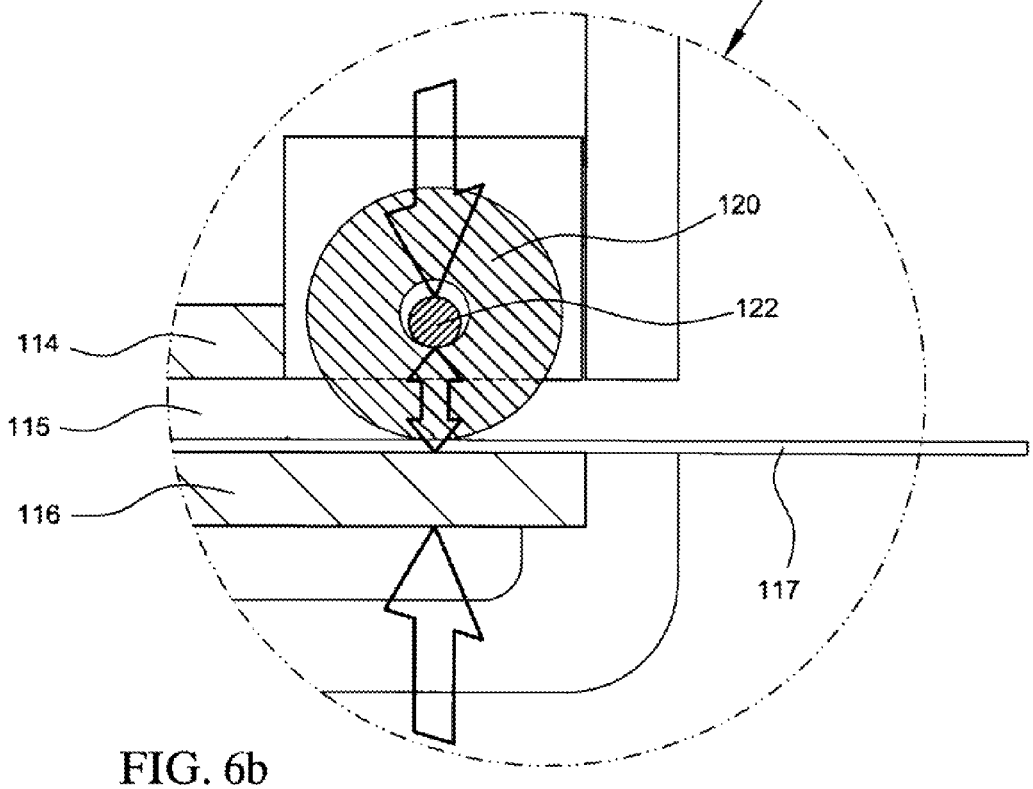
FIG. 6*b* is an enlarged view of the encircled part in FIG. 6*a;*
Figure 7A:
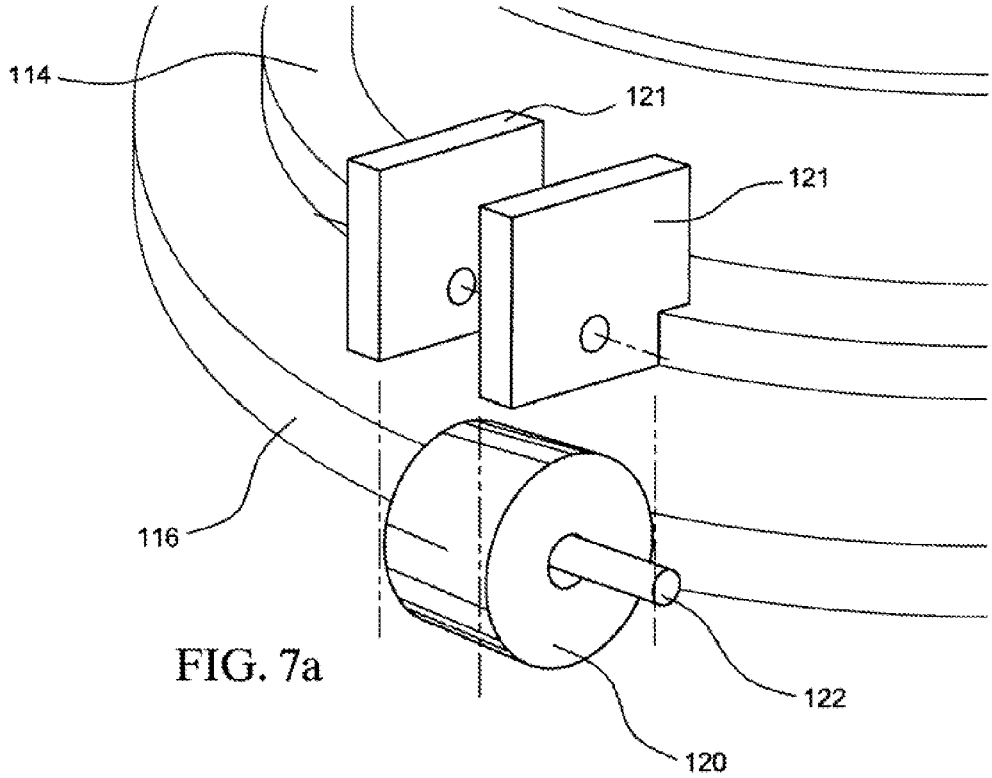
FIG. 7*a* is an exploded perspective view showing the wheel of the paper punch shown in FIG. 6*a;*
Figure 7B:
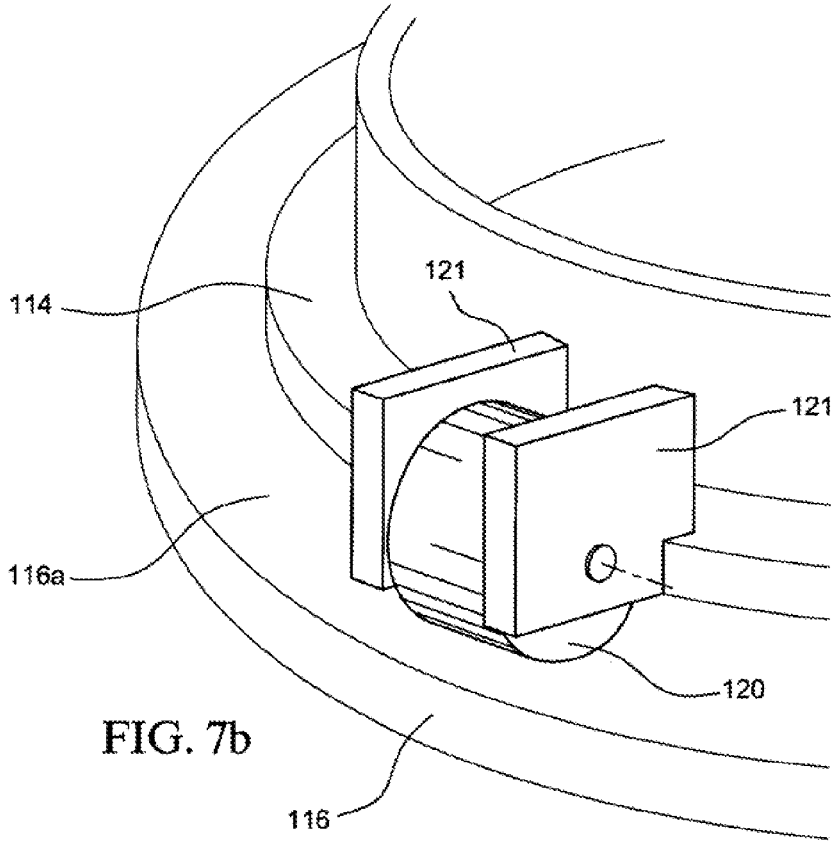
FIG. 7*b* is a perspective view showing the wheel assembled to the paper punch shown in FIG. 6*a;*

As shown in more detail in FIGS. 6*b* to 7*b*, a restricting mechanism is provided adjacent the front end of the upper jaw 114 for limiting the extent of downward movement of the upper jaw 114 towards the lower jaw 116. The restricting mechanism includes a wheel 120 30 carried by a pair of ears 121 fixed with the upper jaw 114 via a pin 122. The wheel 120 has an inner hole of a diameter larger than the outer diameter of the pin 122, so that the wheel 120 can rotate and move up and down (in the sense as shown in FIGS. 6*a* and 6*b*, and along a path parallel to the path of movement of the die 104 relative to the die holder 106 relative to the pin 122. The pin 122 cannot, however, exhibit any up and down movement relative to the pair of ears 121. Normally, in the absence of any paper received within the slot 115 of the paper punch 100, the wheel 120 contacts an upper surface 116*a* of the lower jaw 116.

Figure 8A:
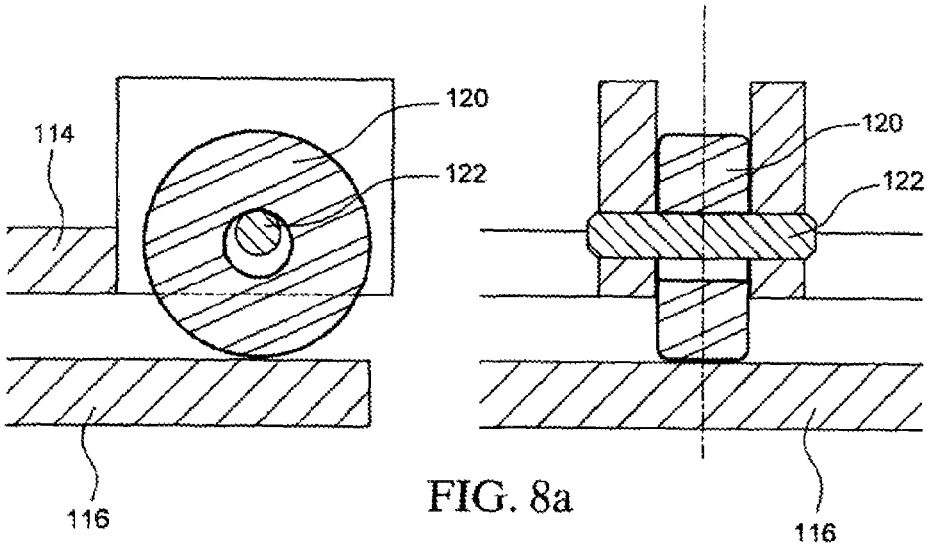
FIGS. 8*a* to 8*c* show the relative movement among the upper jaw, lower jaw and the wheel of the paper punch shown in FIG. 6*a* before, during and after a punching action.
Figure 8B:
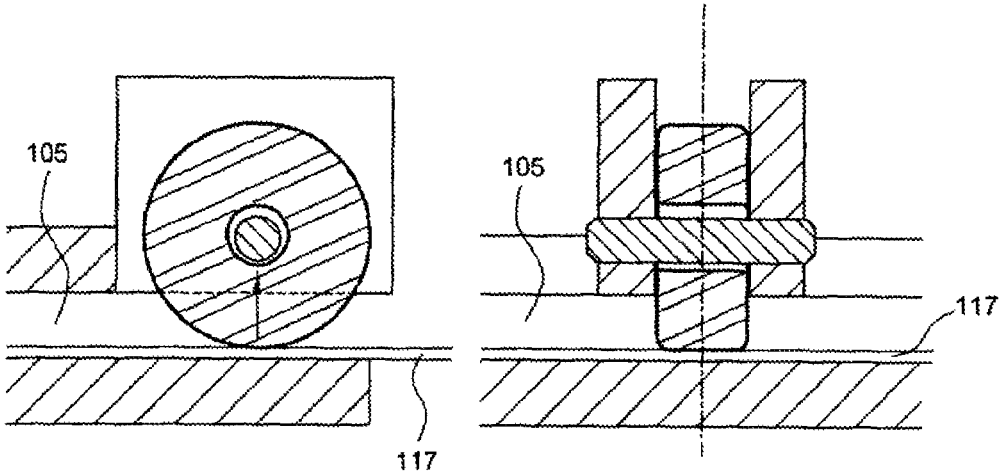
Figure 8C:
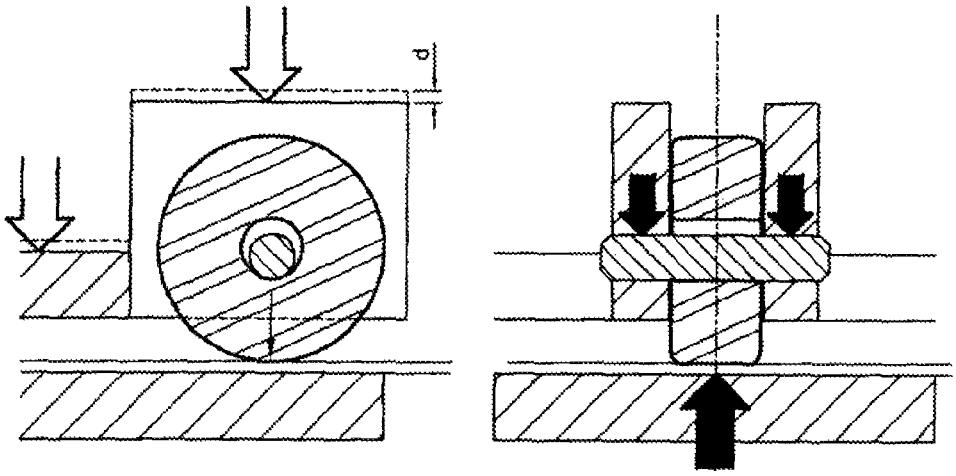

Turning now to FIGS. 8*a* to 8*c*, such show operation of the restricting mechanism of the paper punch 100 of the present invention. As shown in FIG. 8*a*, when no paper is received within the slot 105 of the paper punch 100, the wheel 120 sits on top of the lower jaw 116, and the pin 122 contacts an upper part of the inner hole of the wheel 120. When a piece of paper 117 is inserted into the slot 105 of the die holder 106 via the front end of the die holder 106, the wheel 120 is caused to rotate and also move upward relative to the pin 122 by a distance equal to the thickness of the piece of paper 117, and sits on the sheet of paper 117.

It can be seen in FIG. 6*a* that, in this configuration when at the end of the downward punching action, a plate 118 of the die 104 sits on top of an upstanding wall of the upper jaw 114 of the die holder 106, and thus exerts a downward pressure on the upper jaw 114. Thus, as shown in FIG. 8*c*, at the end of the downward movement of the die 104 relative to the die holder 106, the die 104 will bend the upper jaw 114 downward towards the lower jaw 116. However, the maximum distance d of downward movement of the upper jaw 114 towards the lower jaw 116 which is allowed in this arrangement is limited to:

Diameter of inner hole of wheel 120—Outer diameter of pin 120—Thickness of Paper 117

Thus, when in the configuration as shown in FIG. 8*c*, the upper jaw 114 cannot move any closer to the lower jaw 116.

Incidentally, the restricting mechanism also limits the thickness of paper which may be received within the slot 105 of the die holder 106, as the sheet of paper 117 cannot be thicker than the difference between the diameter of the inner hole of the wheel 120 and the outer diameter of the pin 120.

Figure 9A:
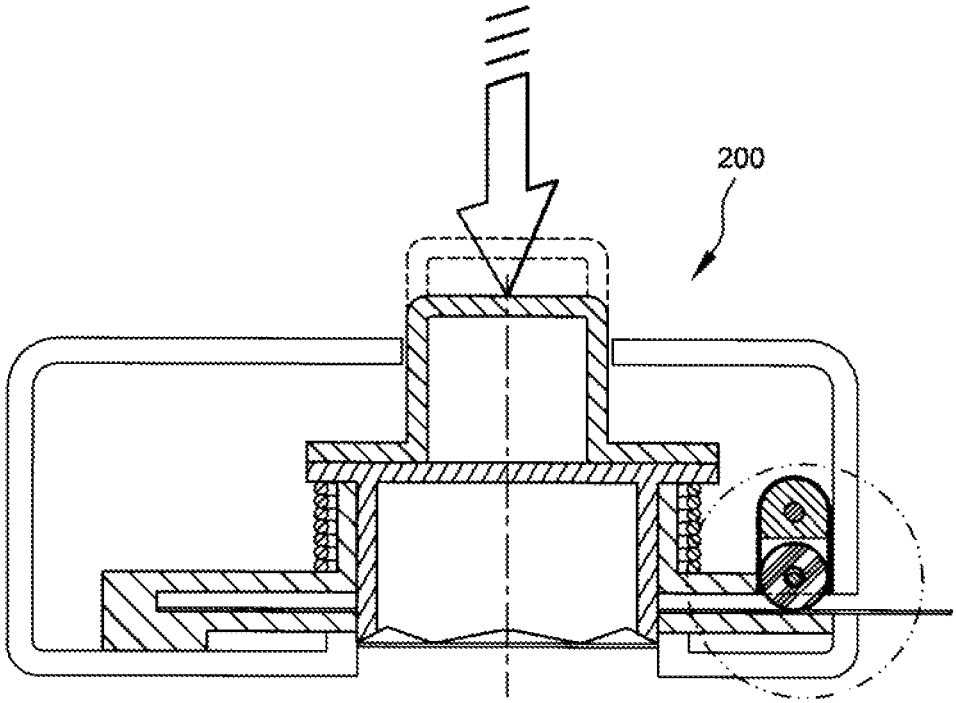
FIG. 9*a* is a sectional view of a paper punch according to a second embodiment of the present invention.
Figure 9B:
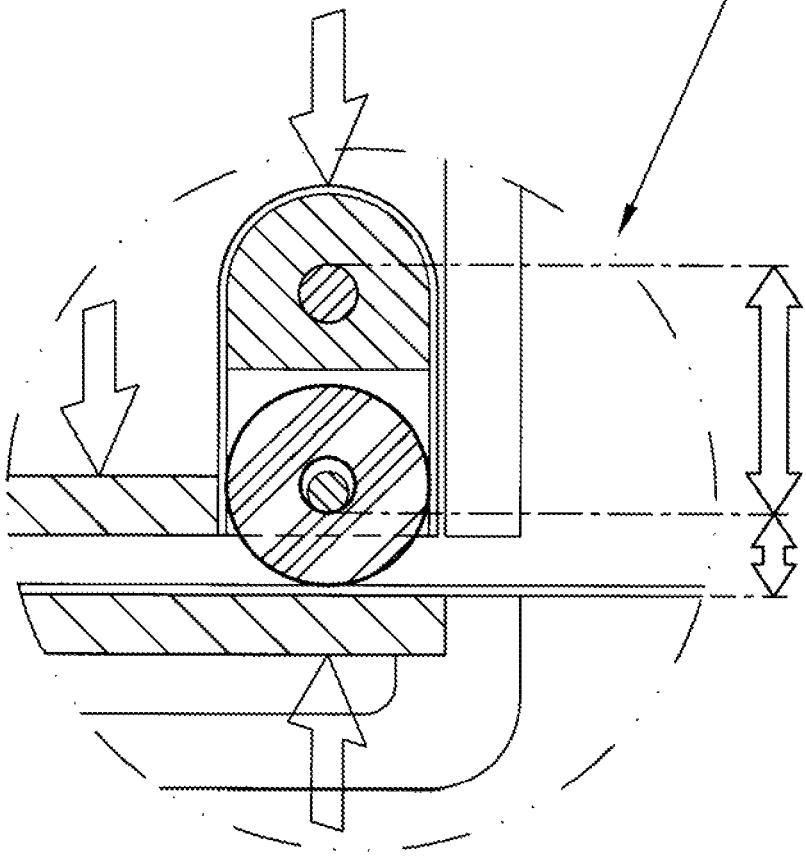
FIG. 9*b* is an enlarged view of the encircled part in FIG. 9*a;*
Figure 10A:
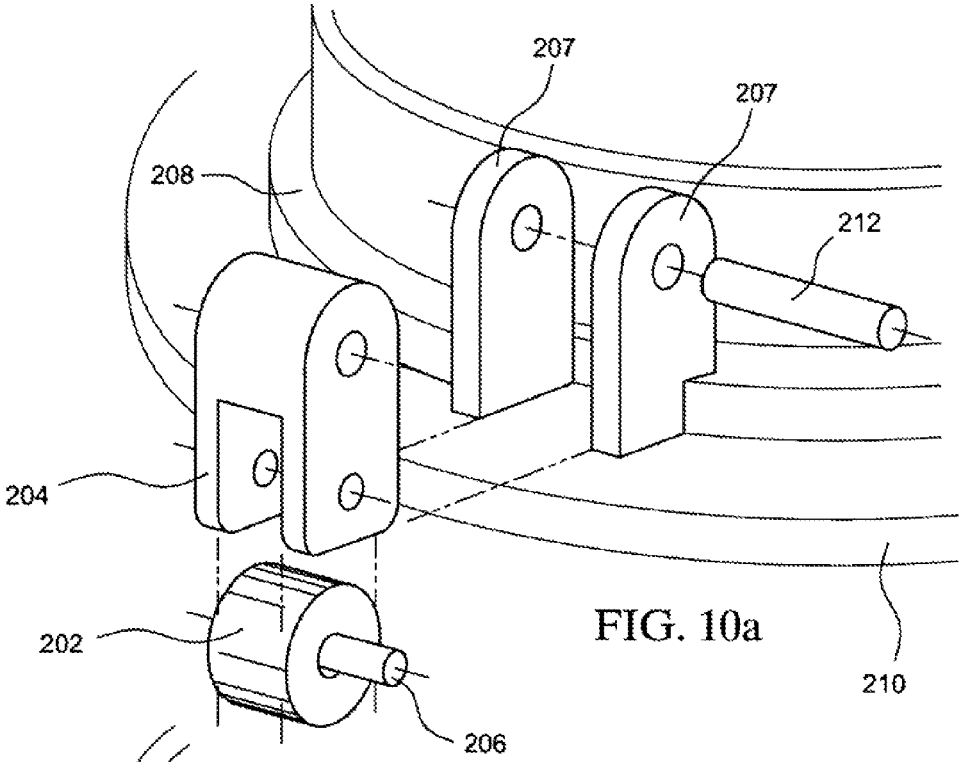
FIG. 10*a* is an exploded perspective view showing the wheel of the paper punch shown in FIG. 9*a;*
Figure 10B:
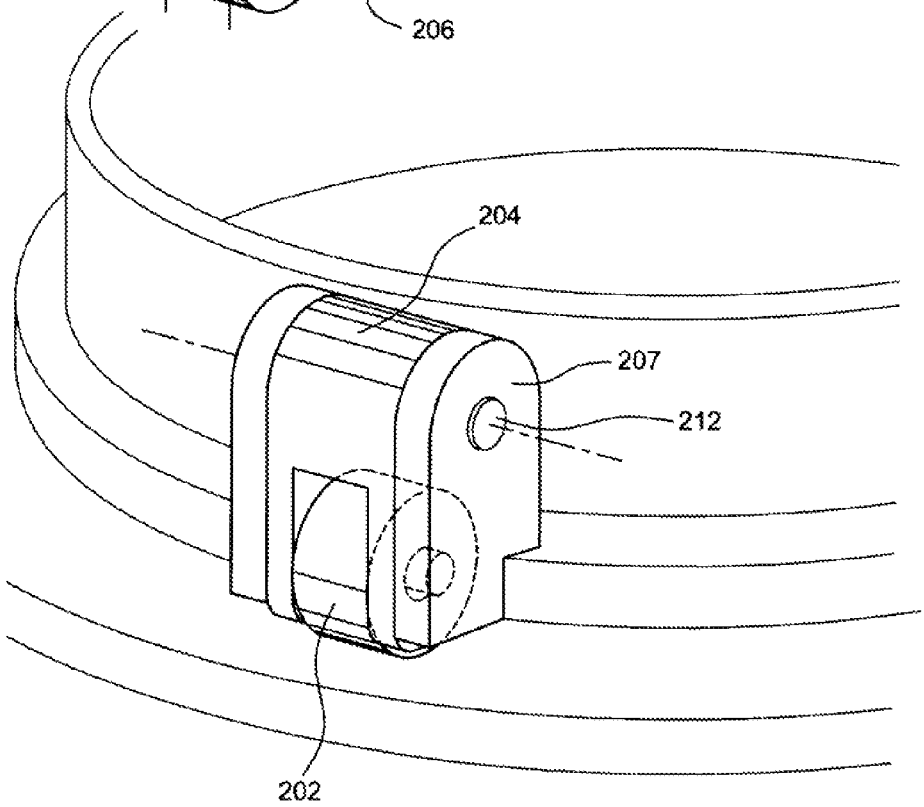
FIG. 10*b* is a perspective view showing the wheel assembled to the paper punch shown in FIG. 9*a*.

A paper punch according to a second embodiment of the present invention, as shown in FIGS. 9*a* and 9*b* and generally designated as 200, is structurally similar to the paper punch 100 discussed above. A major difference between the paper punches 100, 200 is that, in the paper punch 200, and as shown in more detail in FIGS. 10*a* and 10*b*, a wheel 202 is carried by a holder 204 via a pin 206. The holder 204 is fixed to a pair of ears 207 of an upper jaw 208 of a die holder 210 via a pin 212, such that the holder 204 is prevented from exhibiting any up and down movement (in the sense shown in FIGS. 11*a* to 11*c*) relative to the pair of ears 207. On the other hand, as the diameter of an inner hole of the wheel 202 is larger than the diameter of the pin 206, the wheel 202 can rotate and move up and down relative to the pin 206 and the holder 204.

Figure 11A:
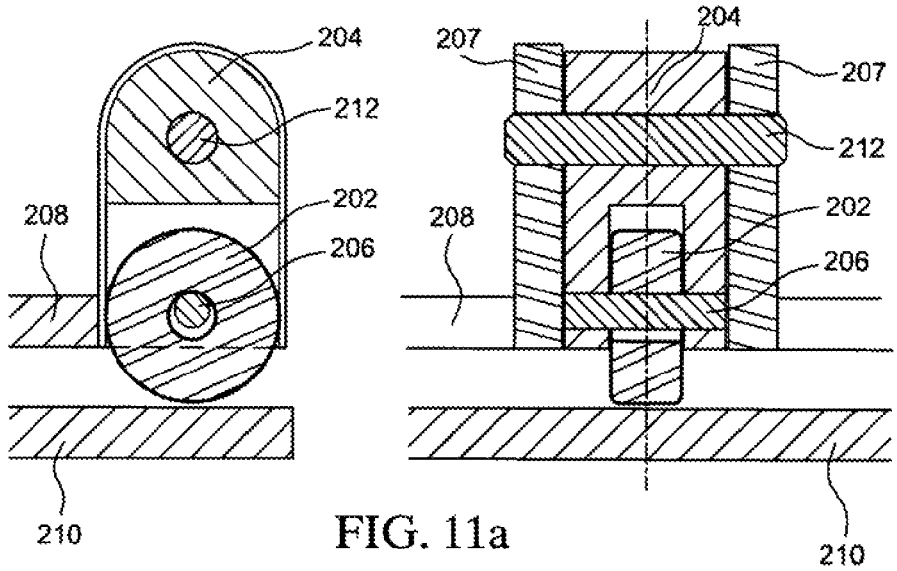
FIGS. 11*a* to 11*c* show the relative movement among the upper jaw, lower jaw and the wheel of the paper punch shown in FIG. 9*a* before, during and after a punching action.
Figure 11B:
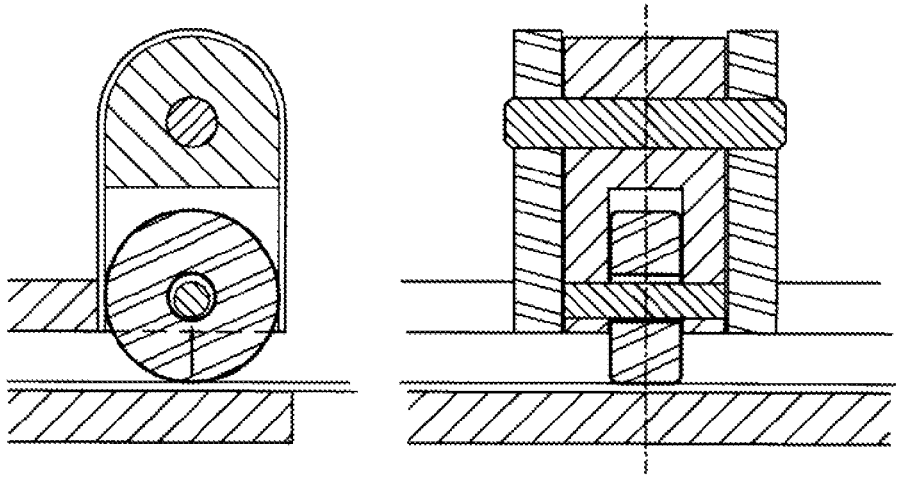
Figure 11C:
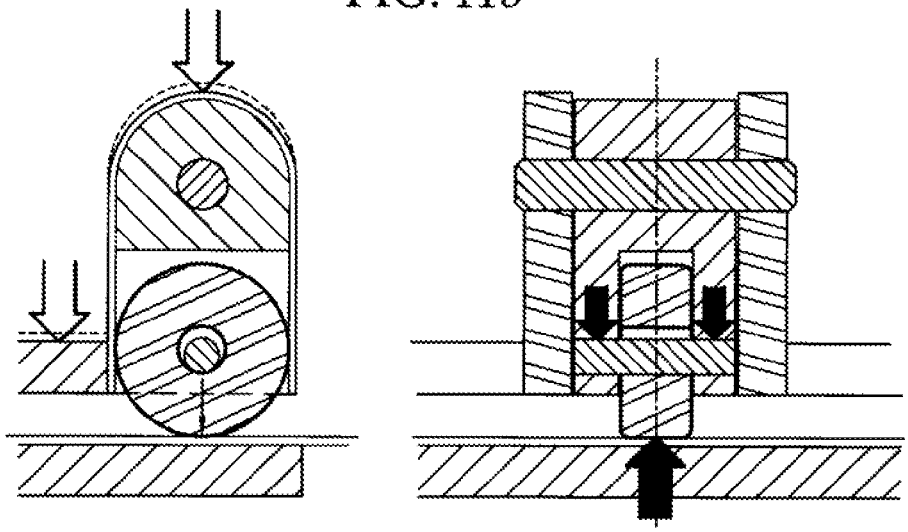

Turning now to FIGS. 11*a* to 11*c*, such show operation of the restricting mechanism of the paper punch 200 according to the present invention, which is similar to the principle of operation of the restricting mechanism in the paper punch 100, discussed above.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. A paper punch comprising:

an operating member;

a die; and a die holder with an upper jaw member and a lower jaw member which are spaced apart from each other by a slot;

wherein said operating member is operable to move said die relative to said die holder to punch at least a piece of paper out from a sheet of paper received within said slot of said paper punch;

wherein said upper jaw member of said die holder includes an unpowered restrictor adapted to limit the extent of relative movement between said upper and lower jaw members;

wherein insertion of said piece of paper into said slot causes said restrictor to move relative to said upper jaw member along a path substantially parallel to a path of movement of said die relative to said die holder;

wherein said lower jaw member has a flat surface facing said upper jaw member; and, wherein, when in an absence of said sheet of paper within said slot, said restrictor contacts said flat surface of said lower jaw member wherein said restrictor is a wheel member that has a hole with a diameter larger than that of a pin about which said wheel member is rotatable, the maximum extent of relative movement between said upper and lower jaw members is determined by the difference between said diameter of said hole of said wheel member and said diameter of said pin.

2. A paper punch comprising:

an operating member;

a die; and a die holder with an upper jaw member and a lower jaw member which are spaced apart from each other;

wherein said operating member is operable to move said die relative to said die holder to punch at least a piece of paper out from a sheet of paper received within said paper punch;

wherein said upper jaw member of said die holder includes an unpowered restrictor adapted to limit the extent of relative movement between said upper and lower jaw members;

wherein said lower jaw member has a flat surface facing said upper jaw member; and, wherein, when in an absence of said sheet of paper within said slot, said restrictor contacts said flat surface of said lower jaw member wherein said restrictor is a wheel member that has a hole with a diameter larger than that of a pin about which said wheel member is rotatable, the maximum extent of relative movement between said upper and lower jaw members is determined by the difference between said diameter of said hole of said wheel member and said diameter of said pin.

* * * * *